US012215889B2

(12) United States Patent
Conrad et al.

(10) Patent No.: US 12,215,889 B2
(45) Date of Patent: Feb. 4, 2025

(54) HUMIDIFIER FOR A FAN COIL

(71) Applicant: OMACHRON INTELLECTUAL PROPERTY INC., Hampton (CA)

(72) Inventors: Wayne Ernest Conrad, Hampton (CA); Scott Card, Burketon (CA)

(73) Assignee: Omachron Intellectual Property Inc., Hampton (CA)

( * ) Notice: Subject to any disclaimer, the term of this patent is extended or adjusted under 35 U.S.C. 154(b) by 781 days.

(21) Appl. No.: 17/321,203

(22) Filed: May 14, 2021

(65) Prior Publication Data

US 2022/0034529 A1 Feb. 3, 2022

(30) Foreign Application Priority Data

Jul. 29, 2020 (CA) ..... 3088411

(51) Int. Cl.

| | |
|---|---|
| ***F24F 6/02*** | (2006.01) |
| ***F22B 37/56*** | (2006.01) |
| ***F24F 1/0087*** | (2019.01) |
| ***F24F 11/00*** | (2018.01) |
| ***F24H 15/246*** | (2022.01) |
| *F24F 6/12* | (2006.01) |
| *F24F 11/80* | (2018.01) |
| *F24F 110/20* | (2018.01) |

(52) U.S. Cl.

CPC ..... *F24F 6/02* (2013.01); *F22B 37/565* (2013.01); *F24F 1/0087* (2019.02); *F24F 11/0008* (2013.01); *F24H 15/246* (2022.01); *F24F 6/12* (2013.01); *F24F 11/80* (2018.01); *F24F 2110/20* (2018.01)

(58) Field of Classification Search

CPC ..... F22B 37/565; F24F 1/0087; F24F 6/02; F24F 6/12; F24F 11/0008; F24F 11/80; F24F 2110/20; F24H 15/246

USPC ..... 431/1

See application file for complete search history.

(56) References Cited

U.S. PATENT DOCUMENTS

| | | | | |
|---|---|---|---|---|
| 2,256,374 A | | 9/1941 | Cummings, Jr. | |
| 2,358,968 A | * | 9/1944 | Furlong | F24F 6/02 126/350.2 |
| 2,646,061 A | * | 7/1953 | Bottum | F24F 6/04 137/142 |
| 3,643,930 A | * | 2/1972 | Schulze, Sr. | F24F 13/22 261/97 |
| 10,247,431 B2 | | 4/2019 | Conrad | |
| 2011/0140291 A1 | * | 6/2011 | Hoglund | F24F 6/18 261/141 |

FOREIGN PATENT DOCUMENTS

| | | |
|---|---|---|
| CA | 2746405 A1 | 11/2012 |
| CA | 2746405 C | 10/2015 |
| CN | 204063306 U | 12/2014 |

OTHER PUBLICATIONS

English machine translation of CN24063306U, published on Dec. 31, 2014.

* cited by examiner

*Primary Examiner* — Steven B McAllister
*Assistant Examiner* — Benjamin W Johnson
(74) *Attorney, Agent, or Firm* — Philip C. Mendes da Costa; SMART & BIGGAR LP

(57) ABSTRACT

A method for operating a boiler of a humidification unit.

20 Claims, 10 Drawing Sheets

HUMIDIFIER FOR A FAN COIL

CROSS-REFERENCE TO RELATED APPLICATIONS

This application claims the benefit of Canadian Patent Application No. 3088411 filed on Jul. 29, 2020, the content of which is incorporated herein by reference.

FIELD

This application relates to humidifiers for fan coils and fan coils including the same.

INTRODUCTION

The following is not an admission that anything discussed below is part of the prior art or part of the common general knowledge of a person skilled in the art.

A humidifier is a device for increasing the concentration of water vapor (i.e., humidity) present in the air. A humidifier may generate and release moisture into the air.

A fan coil is a device for heating and/or cooling air. A fan coil may include a fan for generating air flow, and a heat exchanger (i.e., coil) for transferring heat between the air flow and the heat exchanger.

Various residential, commercial, and industrial heating, ventilation and air conditioning (HVAC) systems may include one or more fan coil(s) and/or humidifier(s).

SUMMARY

The following introduction is provided to introduce the reader to the more detailed discussion to follow. The introduction is not intended to limit or define any claimed or as yet unclaimed invention. One or more inventions may reside in any combination or sub-combination of the elements or process steps disclosed in any part of this document including its claims and figures.

In accordance with one aspect of this disclosure, which may be used alone or in combination with any other aspect, there is provided a humidifier for a fan coil that includes an upstream temperature sensor and a downstream temperature sensor. The upstream temperature sensor is provided upstream the heat exchanger of the fan coil, and the downstream temperature sensor is provided downstream the heat exchanger. The upstream and downstream temperature sensors are used determine whether the fan coil is in a heating mode. A humidification unit is activated if the fan coil is in the heating mode. An advantage of this aspect is that the humidifier can determine the operational mode of the fan coil without receiving signals from the control system of the fan coil. This may allow the humidifier to be easily integrated with the fan coil.

In accordance with this broad aspect, there is provided a humidifier for a fan coil, the fan coil having an air flow path extending from a return air inlet port to a treated air outlet port with a heat exchange unit positioned in the air flow path, the heat exchange unit in thermal communication with a heat source, the humidifier including:

a) an upstream temperature sensor provided in the air flow path upstream of the heat exchanger;

b) a downstream temperature sensor provided in the air flow path downstream of the heat exchanger;

c) a humidification unit in flow communication with the air flow path whereby, when the humidification unit is actuated, water is provided to air in the air flow path; and, d) a controller operably connected to the humidification unit, wherein in operation the controller receives an upstream signal from the upstream temperature sensor and a downstream signal from the downstream temperature sensor, and upon the controller determining that the fan coil is in a heating mode based on the upstream and downstream signals the controller activates the humidification unit.

In any embodiment, the humidifier may further include a humidity sensor in the air flow path, the humidity sensor providing a humidity signal to the controller whereby the controller activates the humidification unit when the fan coil is in the heating mode and when a humidity level in the air flow path is below a predetermined humidity level.

In any embodiment, the humidity sensor may be positioned in the air flow path downstream of the heat exchange unit.

In any embodiment, the controller may deactivate the humidification unit when a humidity level in the air flow path is above the predetermined humidity level.

In any embodiment, the controller may deactivate the humidification unit when the fan coil is not in the heating mode.

In any embodiment, the humidification unit may include a boiler and the humidifier may include a water level sensor which provides a water level signal to the controller when a water level in the boiler is below a predetermined water level whereupon the controller deactivates the boiler.

In any embodiment, the humidification unit may include at least one inlet valve for controlling ingress of water into the boiler, the controller may be operably connected to the inlet valve, wherein the controller actuates the inlet valve to admit water to the boiler when the water level in the boiler is below the predetermined water level.

In any embodiment, the humidifier may further include a tube that is fluidly connected with the boiler and positioned so that the tube has a water level substantially equal to the water level in the boiler, wherein the water level sensor measures the water level in the tube.

In any embodiment, the water level sensor may include an optical sensor, wherein the water level sensor measures the water level in the boiler based on an optical transmittance of the tube.

In any embodiment, the water level sensor may provide a water level signal to the controller when the water level in the boiler is above the predetermined water level whereupon the controller deactivates the boiler.

In any embodiment, the humidification unit may include at least one outlet valve for controlling the egress of water from the boiler, the controller may be operably connected to the outlet valve, wherein the controller actuates the outlet valve to drain the boiler when the water level in the boiler is above the predetermined water level.

In accordance with another aspect of this disclosure, which may be used alone or in combination with any other aspect, there is provided a method of operating a boiler of a humidification unit. The method involves overfilling the boiler to a particular water level and draining the boiler to substantially remove water from the boiler, at least twice. An advantage of this aspect is that mineral build up and/or microbial growth in the boiler may be reduced.

In accordance with this aspect, there is provided a method for operating a boiler of a humidification unit, the boiler initially filled to a first water level, the method involving:

a) draining the boiler to substantially remove water from the boiler;

b) subsequently filing the boiler with water to a second water level, the second water level being greater than the first water level;

c) subsequently draining the boiler to substantially remove water from the boiler;

d) subsequently filing the boiler with water to the second water level;

e) subsequently draining the boiler to substantially remove water from the boiler; and, f) subsequently filling the boiler with water to the first water level.

In any embodiment, the method may further involve, prior to draining and filing the boiler, detecting a trigger condition, wherein the boiler is drained and filled if the trigger condition is detected.

In any embodiment, detecting the trigger condition may involve determining that the boiler has been inactive for a first inactive predetermined time period.

In any embodiment, the first inactive predetermined time may be between 18 and 48 hours.

In any embodiment, the first inactive predetermined time may be between 18 and 36 hours.

In any embodiment, detecting the trigger condition may involve determining that the boiler has been active for a first active predetermined time period.

In any embodiment, the first active predetermined time may be over 15 minutes.

In any embodiment, the first active predetermined time may be over 30 minutes.

In any embodiment, detecting the trigger condition may involve determining that the boiler has been inactive for a first inactive predetermined time period or the boiler has been active for a first active predetermined time period, whichever occurs first.

In any embodiment, the method may further involve:

a) subsequent to determining that the boiler has been inactive for a first inactive predetermined time period, determining that the boiler has been inactive for a second inactive predetermined time period, wherein the second inactive predetermined time period is greater than the first inactive predetermined time period; and, b) in response to determining that the boiler has been inactive for the second inactive predetermined time period:

i. draining the boiler to substantially remove water from the boiler;

ii. subsequently filing the boiler with water to the second water level;

iii. subsequently draining the boiler to substantially remove water from the boiler;

iv. subsequently filing the boiler with water to the second water level; and, v. subsequently draining the boiler to substantially remove water from the boiler.

In any embodiment, the first inactive predetermined time may be between 18 and 48 hours and the second inactive predetermined time may be between 48 and 96 hours.

In any embodiment, the first inactive predetermined time may be between 18 and 36 hours and the second inactive predetermined time may be between 54 and 90 hours.

In any embodiment, detecting the trigger condition may involve determining that the boiler exceeds a predetermined water level when the boiler is active.

In any embodiment, detecting the trigger condition may involve determining that the boiler contains water exceeding a predetermined salinity level.

In any embodiment, the method may further involve deactivating the boiler prior to step a) and activating the boiler to boil water subsequent to step f).

In any embodiment, the method may further involve, subsequent to determining that the triggering condition has occurred:

a) draining the boiler to substantially remove water from the boiler;

b) subsequently filing the boiler with water to the second water level;

c) subsequently draining the boiler to substantially remove water from the boiler;

d) subsequently filing the boiler with water to the second water level; and, e) subsequently draining the boiler to substantially remove water from the boiler.

In any embodiment, detecting the trigger condition may involve determining that the boiler has been inactive for a first inactive predetermined time period or the boiler has been active for a first active predetermined time period, whichever occurs first.

In any embodiment, the method may further involve:

a) subsequent to determining that the boiler has been inactive for a first inactive predetermined time period, determining that the boiler has been inactive for a second inactive predetermined time period, wherein the second inactive predetermined time period is greater than the first inactive predetermined time period; and, b) in response to determining that the boiler has been inactive for the second inactive predetermined time period:

i. draining the boiler to substantially remove water from the boiler;

ii. subsequently filing the boiler with water to the second water level;

iii. subsequently draining the boiler to substantially remove water from the boiler;

iv. subsequently filing the boiler with water to the second water level; and, v. subsequently draining the boiler to substantially remove water from the boiler.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

Figure 1:
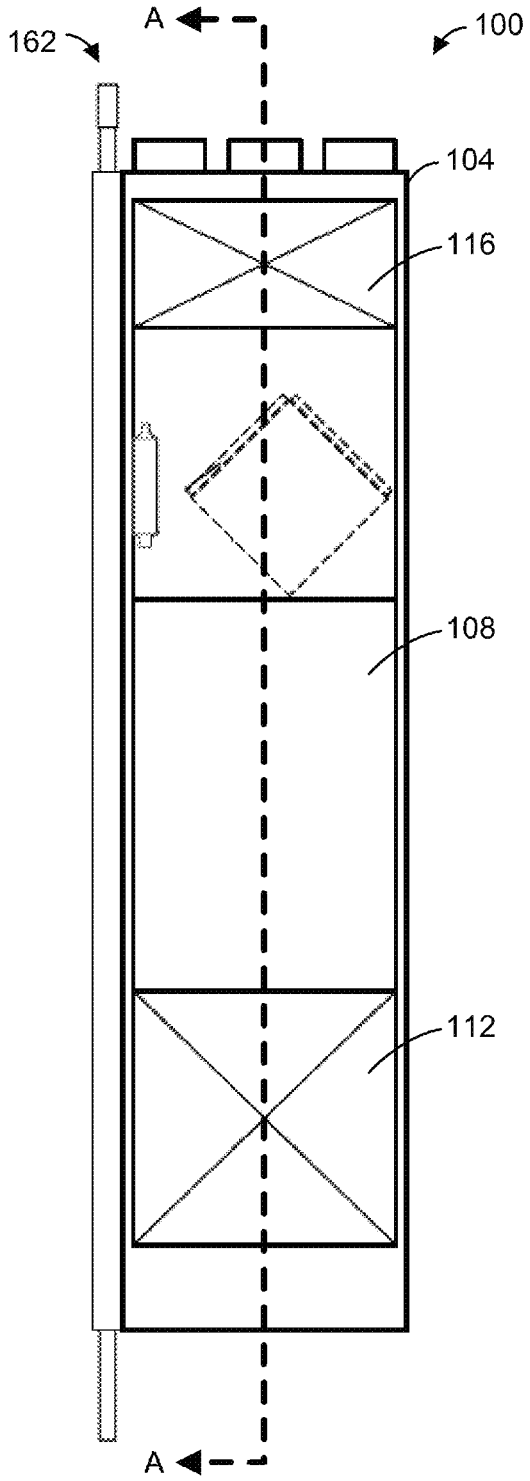
FIG. 1 is a front elevation view of an example fan coil, in accordance with an embodiment.

The drawings included herewith are for illustrating various examples of articles, methods, and apparatuses of the teaching of the present specification and are not intended to limit the scope of what is taught in any way.

DESCRIPTION OF EXAMPLE EMBODIMENTS

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. None of the terms "coupled", "connected", "attached", and "fastened" distinguish the manner in which two or more parts are joined together.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

As used herein, the wording "and/or" is intended to represent an inclusive—or. That is, "X and/or Y" is intended to mean X or Y or both, for example. As a further example, "X, Y, and/or Z" is intended to mean X or Y or Z or any combination thereof.

Fan Coil

The following is a general description of a fan coil having a humidification unit and other features set out herein. The following description contains various features which may be used individually or in any combination or sub-combination.

Figure 2:
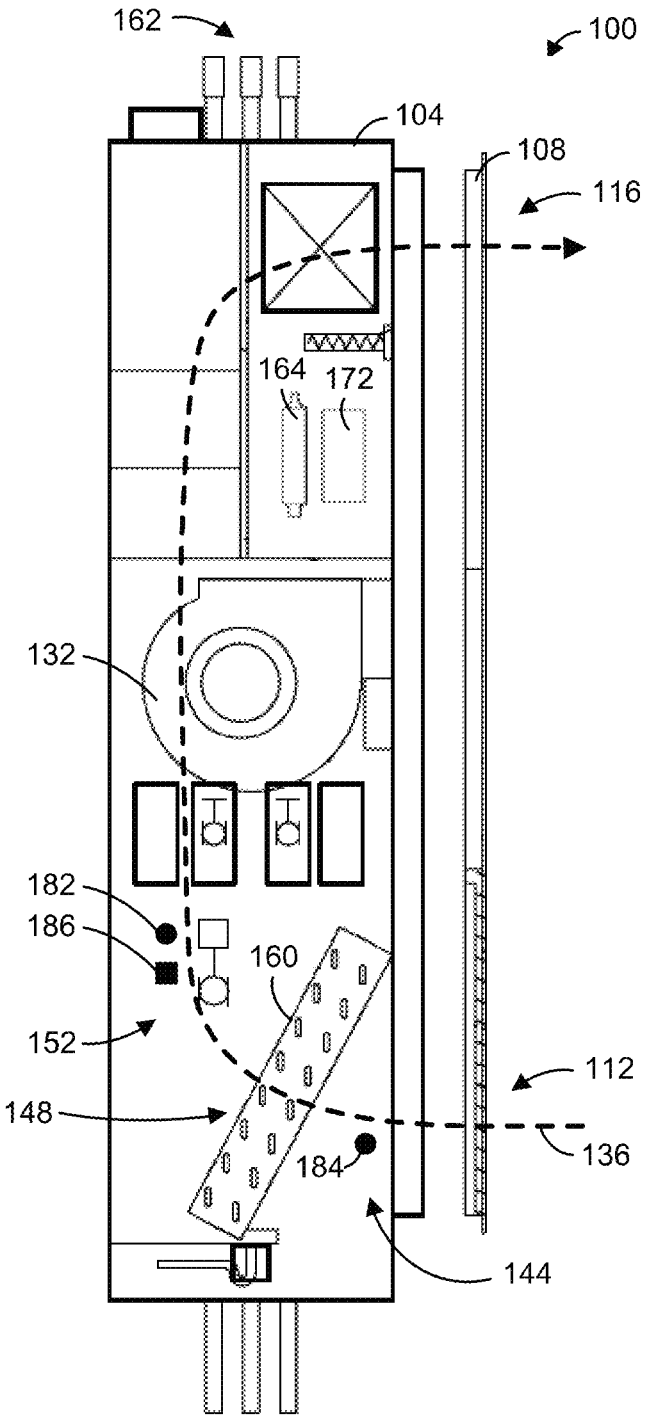
FIG. 2 is a cross-sectional view of the fan coil taken along line A-A in FIG. 1.

Referring to FIGS. 1 and 2, there is shown an example fan coil 100, in accordance with an embodiment. In the illustrated example, the fan coil 100 includes a housing 104 including a front face 108 defining a return air inlet port 112 and a treated air outlet port 116. The fan coil 100 is operable to receive air from the inlet 112, heat or cool the air introduced from the inlet 112 and, as selected, humidify the air, and discharge the treated air through the outlet 116 into a room.

The example shown includes a housing 104 that is substantially cuboid (i.e. box-shaped). An advantage of this design is that it provides an efficient and convenient form factor for applications where the fan coil 100 is recessed into a flat wall. However, in alternative embodiments, the fan coil housing 104 can have any size and shape best suited for the intended application.

In the example shown, the fan coil inlet 112 and outlet 116 are formed in the front face 108 of the fan coil housing 104. This design provides an efficient self-contained apparatus that can be easily accommodated into a room design. However, in alternative embodiments, the fan coil inlet 112, the fan coil outlet 116, or both may be located remotely from the fan coil housing 104. For example, the fan coil outlet 116 may be fluidly connected to the fan coil housing 104 by one or more air flow conduits to allow the fan coil 100 to service one or more rooms remote from the fan coil 100 (e.g., via ducting built into a wall or ceiling of a building). In some embodiments, fan coil 100 may include a plurality of fan coil air inlets 112, a plurality of fan coil air outlets 116, or a plurality of fan coil air inlets 112 and a plurality of fan coil air outlets 116. For example, fan coil 100 may include a plurality of fan coil air outlets 116 directed to different rooms. This allows one fan coil 100 to service several rooms.

It will be appreciated that the fan coil 100 may be of any design known in the art and may use any flow path, and any heating and air conditioning units known in the heating and cooling arts. In the example shown in FIG. 2, the fan coil 100 includes an air blower 132 and an air flow path 136 which extends from the fan coil air inlet 112 to the fan coil air outlet 116. In the illustrated example, the air flow path 136 includes a heating zone 148 between an upstream first portion 144 of the fan coil air flow path 136, and a downstream second portion 152 of the fan coil air flow path 136.

The heating zone 148 can include any air heating device capable of heating the air moving downstream across the heating zone 148. In the illustrated example, the air heating device is provided by a heat exchange unit 160 in thermal communication with a heat source. As shown, the heat source is provided by heated water circulated through supply and return pipes 162. In other embodiments, the air heating device may be provided by resistive heating elements, a natural gas burner, or the like. In some embodiments, the air heating device includes a heat recovery ventilator (HRV) or an energy recovery ventilator (ERV) that receives heat, or heat and humidity, from exhausted room air for use, e.g., in treating fresh air introduced into the unit from the outside.

Still referring to FIGS. 1 and 2, the fan coil 100 is shown including a humidification unit 164 in flow communication with the air flow path 136. The humidification unit 164 is operable to humidify air in the fan coil air flow path 136 so that humidified air is discharged from the fan coil air outlet 116. When air is heated in the heating zone 148, the relative humidity of the air may decrease. The humidity added by the humidification unit 164 can help to maintain or increase the relative humidity of the air after heating.

In the illustrated example, the humidification unit 164 is positioned in and discharges water mist into the air flow path 136 downstream of the heating zone 148. An advantage of discharging the water mist downstream of the heating zone 148 is that the low relative humidity of the heated air allows the water mist to be more efficiently absorbed. As a result, less water mist generation may be required and less water mist may accumulate in the fan coil which may result in rusting of the apparatus or leaking of water from the fan coil apparatus. In turn, the humidification unit 164 may consume less power by activating less frequently, activating at a lower power setting, or by including a less powerful water mist production member. Also, less water may be consumed by the humidification unit 164 because less water is lost. In alternate embodiments, the humidification unit 164 may be positioned upstream the heating zone 148. An advantage of this design is that cooler air moves through the humidification unit 164, which makes microorganisms, mold, and the like less likely to cultivate inside the humidification unit 164.

In some embodiments, an air regulating device may be operably connected to fan coil apparatus 100. The air regulating device may operate as a thermostat and/or a hygrostat, capable of sensing air temperature and/or air humidity, and signaling the fan coil 100 to generate heated, cooled and/or humidified air in order to maintain the room air at a set temperature and/or humidity. For example, the air regulating device may be programmed to maintain the room air at 21° C. and 40% relative humidity for comfortable human occupancy. The air regulating device can be any thermostat and/or hygrostat device known in the art. For example, the air regulating device may include inputs for user interaction (e.g. buttons to enter a set air temperature and relative humidity), and an optional display (e.g. to display the current air temperature and relative humidity).

Humidification Unit

The following is a general description of a humidification unit that may be used with a fan coil. In accordance with this aspect, the humidification unit comprises a boiler to produce a mist from liquid water. The following description contains various features of a humidification unit which may be used individually or in any combination or sub-combination.

Referring to FIGS. 3 to 8, there is shown an example humidification unit 164, in accordance with an embodiment. In the illustrated example, the humidification unit 164 includes a water inlet 202 and a mist outlet 204. The humidification unit 164 is operable to receive liquid water from the inlet 202, generate water vapor (i.e., mist) from the liquid water, and discharge water mist through the mist outlet 204. In various embodiments, the humidification unit 164 can be positioned within the fan coil 100 so that when the humidification unit 164 is actuated, water can be provided to the air in the air flow path 136. In the illustrated example, the humidification unit 164 includes mounting members 242 for fixing the humidification unit 164 to the fan coil 100. Any mounting member may be used so as to position the humidification unit 164 at any desired location in fan coil 100.

Figure 3:
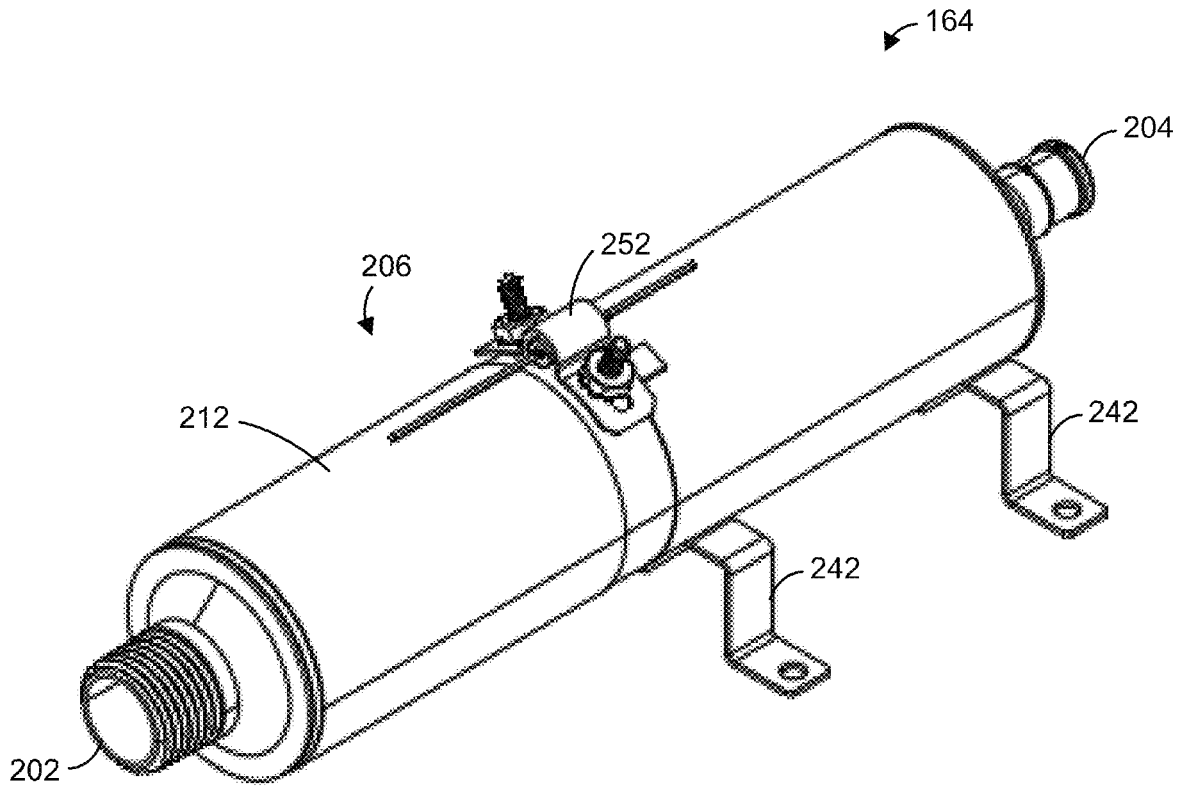
FIG. 3 is a perspective view of an example humidification unit, in accordance with an embodiment.
Figure 4:
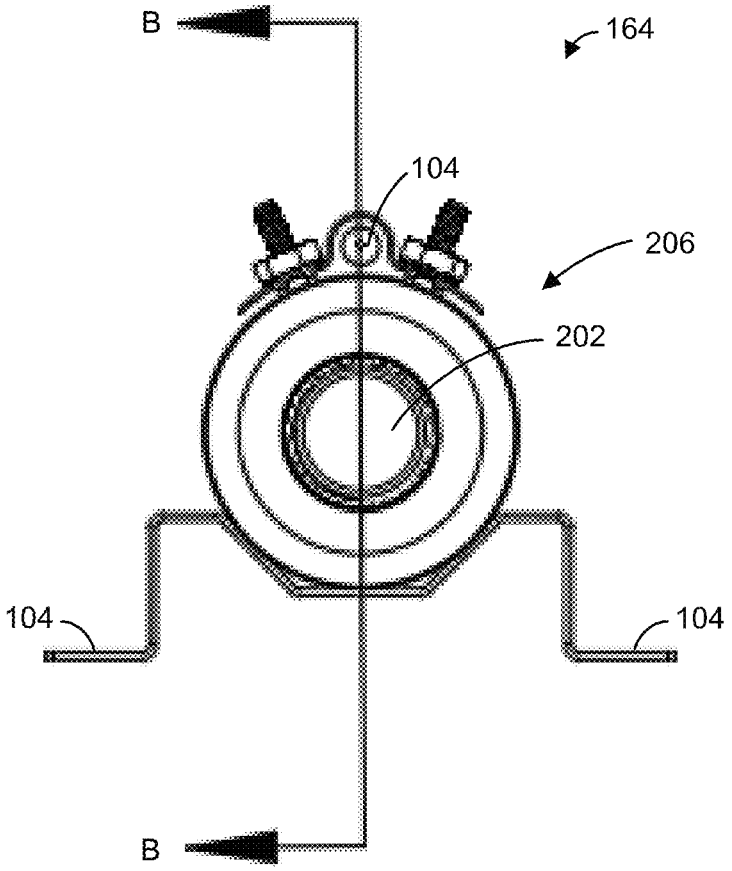
FIG. 4 is a bottom view of the humidification unit of FIG. 3.
Figure 5:
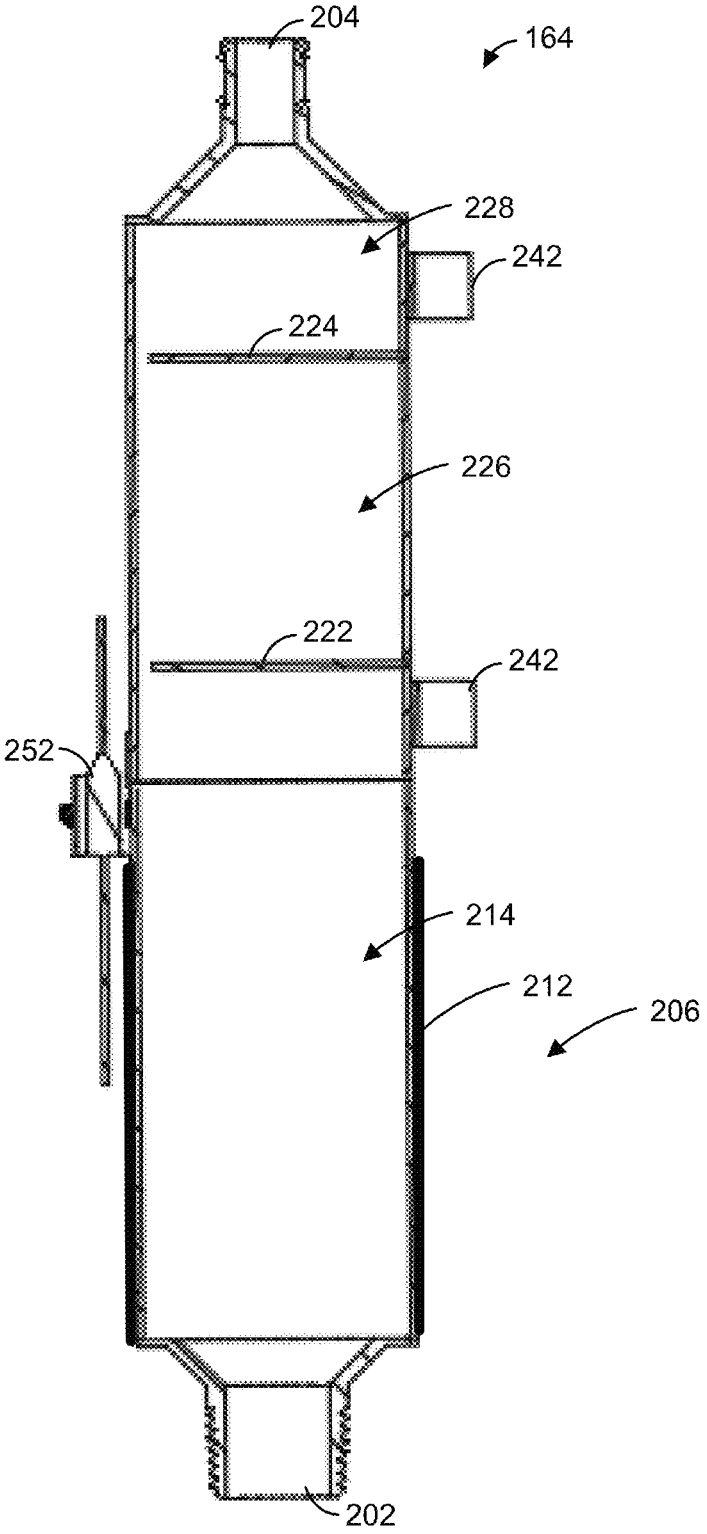
FIG. 5 is a cross-sectional view of the humidification unit taken along line B-B in FIG. 4.
Figure 6:
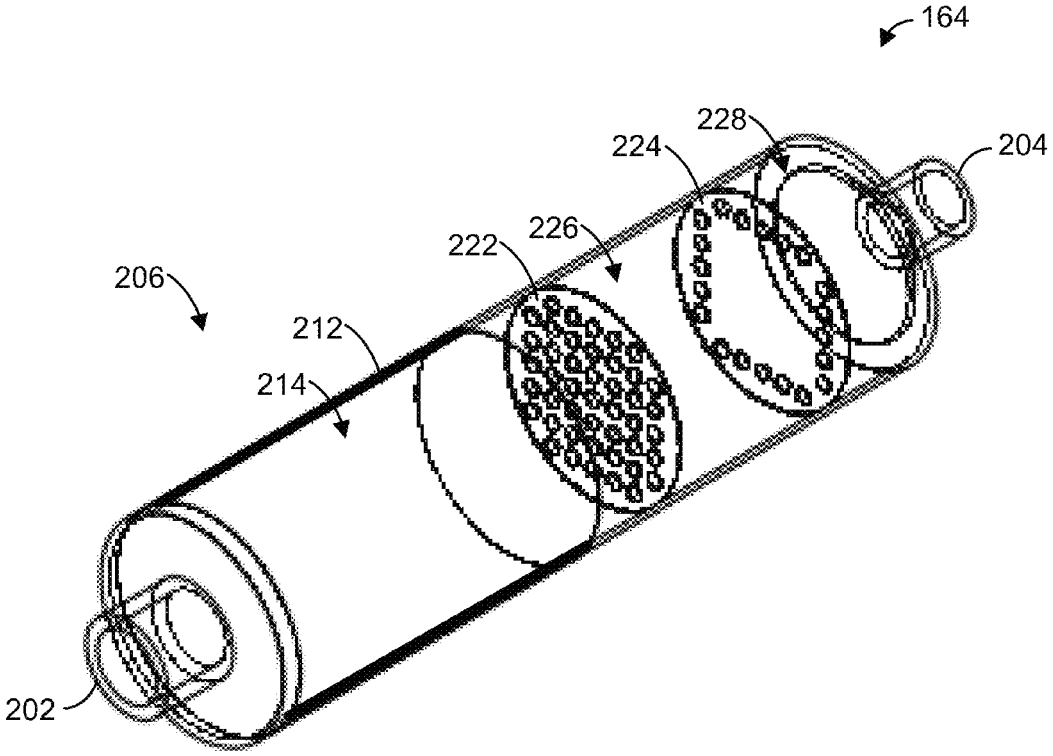
FIG. 6 is a transparent perspective view of the humidification unit of FIG. 3 with its mounting members and temperature sensor removed.
Figure 7:
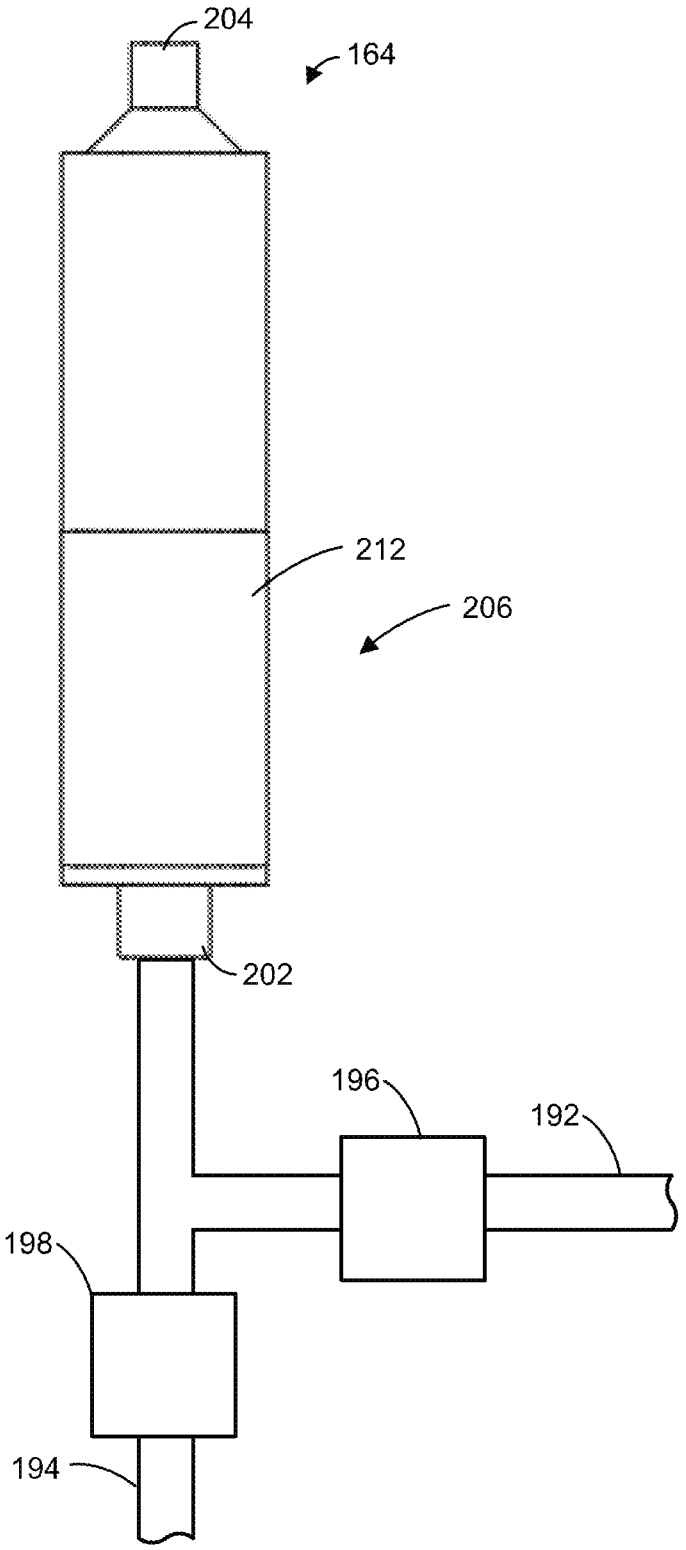
FIG. 7 is a front elevation view of the humidification unit of FIG. 3 showing example inlet and outlet valves.

As exemplified in FIGS. 3, 5, and 6, the humidification unit 164 may include a boiler 206 for generating water vapor. The boiler 206 is operable to store liquid water and heat the stored water using a heating element 212 to generate water vapor. In various embodiments, electrical power can be supplied to the heating element 212 to heat the boiler 206, thereby heating the water stored in the boiler 206. In the illustrated example, the heating element 212 is provided by a thick film resistor disposed on the exterior surface of the boiler 206. An advantage of this design is that the temperature of the water can be more easily controlled as compared to an immersion heater. It should be appreciated that various embodiments are described herein with reference to the boiler 206 for ease of exposition. However, in alternate embodiments, the humidification unit 164 may include other mechanisms for generating water mist, such as an ultrasonic oscillator, an impeller, etc. It will also be appreciated that water may not be stored in boiler 206 but may only be introduced to boiler 206 when the boiler is actuated to produce mist. Accordingly, a valve or the like may be opened to introduce water into boiler before, as or after heating element 212 is actuated.

Boiler 206 may be mounted to fan coil 100 in any orientation. As exemplified in FIG. 2, boiler 206 is oriented generally vertically. However, boiler 206 may be at any orientation to the vertical. Optionally, boiler is at a non-zero angle to the horizontal such that water may drain out of boiler 206 when boiler is not in use (e.g., heating element 212 is not energized).

In various embodiments, the boiler 206 can be filled and drained through the inlet 202. As exemplified in FIG. 7, the boiler 206 may receive liquid water from a first water line 192 and discharge liquid water into a second water line 194. The first water line 192 may be fluidly coupled to a water supply, such as a municipal water line (e.g., a water line in an apartment or condominium) or a reservoir of water (e.g. water tank) external to fan coil apparatus 100. The second water line 194 may be fluidly coupled to a water drain, such as a municipal sewage line or an effluent water storage.

In the illustrated example, an inlet valve 196 regulates the supply of liquid water to the boiler 206 and an outlet valve 198 regulates the discharge of liquid water from the boiler 206. The inlet and outlet valves 196 and 198 each have an open position in which water is allowed to flow past the valve, and a closed position in which the valve prevents the flow of water. In other words, the inlet valve 196 can be actuated to control the ingress of water into the boiler 206, and the outlet valve 198 can be actuated to control the egress of water from the boiler 206. In some embodiments, the inlet and outlet valves 196 and 198 may have multiple open positions that define different rates of flow into and out of the boiler 206. It will be appreciated that when valves 196 and 198 are closed and the heating element 212 is de-energized, water may be stored in boiled 206.

The inlet and outlet valves 196 and 198 can be any valve capable of preventing the flow of water to or from the boiler 206. For example, the inlet and outlet valves 196 and 198 may be an electrical valve (e.g. a solenoid valve). It should be appreciated that the inlet and outlet valves 196 and 198 may be positioned in various locations upstream or downstream the humidification unit 164, such as on the water lines 192 and 194, the water supply/drain, or between the water supply/drain and the water line 192 and 194.

In the illustrated embodiment, the inlet 202 acts as both an inlet and an outlet for liquid water. However, it should be appreciated that the humidification unit 164 may include any number of liquid water inlets, liquid water outlets, and water mist outlets. In some embodiments, the humidification unit 164 may include a liquid water inlet and a separate liquid water outlet.

In some embodiments, the humidification unit 164 may include one or more baffles for restricting the flow of water and/or mist within the boiler 206. In the example shown in FIGS. 5 and 6, the humidification unit 164 includes first and second plates 222 and 224, which define a boiling zone 214, a splash zone 226, and a steam zone 228. As shown, the first and second plates 222 and 224 may be perforated to define a plurality of apertures. In the illustrated example, the first plate 222 is perforated over its entire surface, whereas the second plate 224 is only perforated near its perimeter. An advantage of this design is that the water vapor generated by the humidification unit 164 may flow in a serpentine path. However, it should be appreciated that various perforation patterns are possible.

The first and second plates 222 and 224 may inhibit liquid water from entering the mist outlet 204. For example, turbulence in the liquid water during boiling may cause liquid water to splash within the boiling zone 214. The first and second plates 222 and 224 may block the splashing water from entering the steam zone 228 and the water vapor outlet 204, trapping the splashing water within the boiling zone 214 and the splash zone 226. Additionally, the first and second plates 224 may prevent the discharge of water vapor through the water vapor outlet 204 that may otherwise condense or precipitate back into liquid water. The first and second plates 222 and 224 may trap some of the water vapor in the splash zone 226 and steam zone 228, reducing the rate of discharge of water vapor the mist outlet 204. This may provide time for the water mist to condense and precipitate back into liquid water prior to being discharged from the humidification unit 164. This design may prevent or reduce water from accumulating in the fan coil 100 which may result in rusting of the fan coil 100 or leaking of water from the fan coil 100.

In some embodiments, the humidification unit 164 may include one or more sensors for sensing the temperature of the humidification unit 164. In the example shown in FIGS. 3 to 5, the humidification unit 164 includes a thermal fuse 252. The thermal fuse 252 is operable to interrupt the electrical power supplied to the heating element 212 when temperature of the humidification unit 164 exceeds a certain temperature. An advantage of this design is that the humidification unit 164 can be automatically deactivated when the temperature of the humidification unit 164 exceeds a safe operating temperature.

It will be appreciated that a humidification unit that comprises a boiler 206 may be used with any one or more aspects set out herein.

Control System

The following is a general description of a control system that may be used with a humidification unit. In accordance with this aspect, the control system is operable to actuate the humidification unit without being integrated into the control system of a fan coil 100. Accordingly, a humidification unit may be easily retrofit into an existing fan coil 100. The following description contains various features which may be used individually or in any combination or sub-combination. It will be appreciated that the control system may be used with any humidification unit useable in a fan coil 100.

The control system comprises a controller 172 and a plurality of sensors. The sensors provide input to the controller 172 and enable the controller 172 to provide control signal to the humidification unit 164 based upon the input signals provided by the sensors.

For example, the sensors may include temperature sensors 182, 184 (see for example FIG. 2). Temperature sensors 182, 184 may be positioned upstream and downstream from heating zone 148. When the temperature sensed by downstream temperature sensor 182 is higher than the temperature sensed by upstream temperature sensor 184, e.g., by 10° C., 20° C. or 30° C., the controller 172 may send a signal to energize heating element 212. If valves 196 and 198 are provided, then controller may send a signal to close valve 198 (if it is open) and to open valve 196 (if it is closed). Accordingly, upon determining that the fan coil 1000 is in operation to heat a room, condominium or the like, the controller 172 may send signals to enable water to enter the boiler 206 (opening valve 196 and closing valve 198) and energizing heating element 212. Optionally, heating element 212 is energized a sufficient period of time after the signals are sent to valves 196, 198 such that water is present in boiler 206.

The sensors may optionally also include one or more humidity sensors 186. See for example FIG. 2. An advantage of providing a humidity sensor is that controller 172 may optionally control the operation of humidification unit 206 so as to provide a predetermined amount of mist to the air flow in the fan coil 100 based on, e.g., the temperature and humidity level in the air flow. Accordingly, even when temperature sensors 182, 184 send signals indicative that fan coil 100 is in a heating mode, controller 172 may not send a signal to energize heating element 212 until humidity sensor 186 sends a signal indicative that the humidity level, e.g., in the air flow in fan coil 100, optionally at allocation downstream of the heating zone, is below a particular level. Optionally, the control system includes an interface which allows a user to set a desired humidity level. Alternately, or in addition, the control system may have built in a level of humidity for different temperatures and accordingly the control system may actuate the heating element 212 when the humidity sensor 186 sends a signal indicative that the humidity level is below the present humidity level of the particular temperature that is sensed, e.g., by sensor 182.

Figure 8:
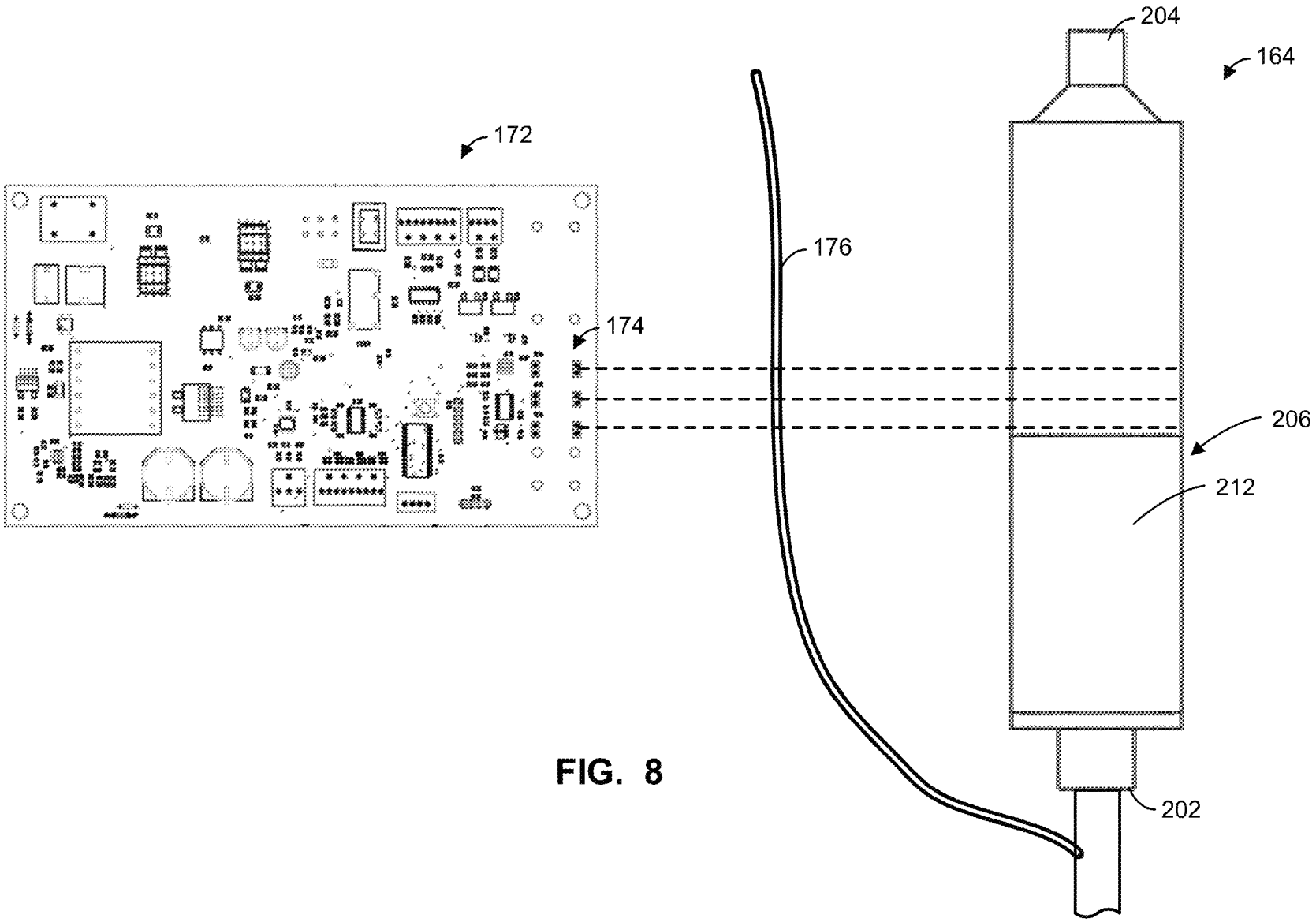
FIG. 8 is a front elevation view of the humidification unit of FIG. 3 showing an example water level sensor and tube.

Optionally, the control system may also include a water level sensor. 174 (see for example FIG. 8). The water level sensor may sense the level of water in humidification unit 164 (e.g., boiler 206). Accordingly, even when temperature sensors 182, 184 send signals indicative that fan coil 100 is in a heating mode, controller 172 may not send a signal to energize heating element 212 if water level sensor 174 sends a signal indicative that the water level in boiler 206 is too low and/or too high.

Accordingly, it will be appreciated that the controller 172 may include logic to receive and act upon control signals to start and stop water mist generation.

Referring to FIGS. 2 and 8, there is shown an example controller 172, in accordance with an embodiment. The controller 172 is operably connected with the humidification unit 164 so that the controller 172 can control the operation of the humidification unit 164 based on signals sent to the control by one or more sensors. In the illustrated example, the controller 172 is provided by a printed circuit board that includes various electronic components mounted thereon. However, it should be appreciated that the controller 172 may be any electronic device suitable for controlling the humidification unit 164. For example, the controller 172 may include a processor, data storage, and a communication interface.

In accordance with this aspect, the controller 172 controls the activation of the humidification unit 164 to control the generation of water vapor. For example, if the humidification unit 164 comprises a boiler 206, the controller 172 may control the activation of the boiler 206. To this end, the controller 172 may regulate the supply of power to the humidification unit 164 to control the activation of the humidification unit 164.

For example, if a water level sensor 174 is provided, then the controller 172 can power off the humidification unit 164 to immediately stop the generation of water vapor, even before the humidification unit 164 runs out of water (e.g., sensor 174 senses a low water level in boiler 206). Shutting off the humidification unit 164 may prevent damage that may be caused by the humidification unit 164 operating without any or sufficient water present. For example, the humidification unit 164 may receive electrical power from an electrical line that is electrically coupled to a power supply, such as a municipal electrical grid (e.g., an electrical outlet or circuit breaker in an apartment or condominium), a power generator, or a power storage device (e.g. battery pack). The controller 172 may be positioned in a circuit between the electrical line and the power supply to regulate the supply of power from the power supply to the humidification unit 164. Accordingly, the controller 172 may prevent the humidification unit 164 from receiving power from power supply to the humidification unit 164 or interrupt the delivery of power if the humidification unit 164 has a low water level, and allow the humidification unit 164 to receive power from power supply to activate the humidification unit 164 if the humidification unit 164 has a sufficient water level.

It will be appreciated that the controller 172 may regulate not only the activation of the humidification unit 164 but also the rate of water mist generation by the humidification unit 164. An advantage of this design is that it allows the rate of water mist generation to be tuned to operate more continuously (and energy efficiently) while maintaining a set air humidity. For example, the controller 172 may reduce (but not halt) the flow power to the humidification unit 164 to slow (but not necessarily stop) the rate of water mist generation. Similarly, the controller 172 may send control signals to the humidification unit 164 instructing the humidification unit 164 to slow (but not necessarily halt) the rate of water mist generation. For example, if the humidity level approaches a set humidity level, then the rate of production of water mist may be reduced. The humidification unit 164 may include logic to receive and act upon signals received from one or more of a humidity sensor 186, a water level sensor 174 and/or one or more temperature sensors 182, 184 to vary the rate of water mist generation.

It will be appreciated that the controller 172 may regulate the amount of liquid water present in the humidification unit 164. For example, the controller 172 may be communicatively coupled with the inlet and outlet valves 196 and 198 to regulate the supply and discharge of water to/from the humidification unit 164 based on, e.g., a signal provided by a water level sensor 174. The controller 172 can direct the position of the inlet and outlet valves 196 and 198 to fill and drain the humidification unit 164 thereby controlling the amount of liquid water within the humidification unit 164.

Temperature sensors 182 and 184 are operable to measure the temperature of the air adjacent to the sensors 182 and 184. The temperature sensors 182 and 184 may be any suitable type of sensor for measuring temperature, such as a thermocouple, a thermistor, a mechanical sensor, etc. The temperature sensors 182 and 184 may include various shielding to reduce noise or other undesired signals.

As shown in FIG. 2, the temperature sensors 182 and 184 can be positioned in the air flow path 136 of the fan coil 100. In the illustrated example, the temperature sensor 182 is positioned downstream of the heat exchange unit 160, and may be referred to herein as a downstream temperature sensor. Likewise, the temperature sensor 184 is positioned upstream of the heat exchange unit 160, and may be referred to herein as an upstream temperature sensor. It will be appreciated that more than one upstream temperature sensor and/or more than one downstream temperature sensor may be provided.

The upstream temperature sensor 182 and the downstream temperature sensor 184 may be communicatively connected to the controller 172 (e.g., wired, wirelessly). In operation, upstream and downstream signals can be received by the controller 172 from the upstream and downstream temperature sensors 182 and 184. The upstream and downstream signals may correspond to the temperature measured by the upstream and downstream temperature sensors 182.

Accordingly the upstream and downstream signals may be used by the controller 172 to determine the operational mode of the fan coil 100. In particular, the controller 172 may determine that the fan coil 100 is in a heating mode, a cooling mode, or inactive, based on the upstream and downstream signals. An advantage of this design is that the controller 172 can determine the operational mode of the fan coil 100 without obtaining signals from the control system of the fan coil 100. Accordingly, a humidification unit 164 may be retrofitted into a fan coil 100 without having to connect controller 172 to the control system for the fan coil 100.

For example, the controller 172 may compare the upstream and downstream signals to determine a temperature difference between the air upstream and downstream of the heat exchange unit 160. If the downstream temperature exceeds the upstream temperature, the controller 172 may determine that the fan coil 100 is in a heating mode. If the upstream temperature exceeds the downstream temperature, the controller 172 may determine that the fan coil 100 is in a cooling mode. If the downstream temperature is approximately equal to the upstream temperature, the controller 172 may determine that the fan coil 100 is inactive. In some embodiments, various thresholds may be used when comparing the upstream and downstream signals. For example, the controller 172 may determine that the fan coil is in a heating mode if the downstream temperature exceeds the downstream temperature by a predetermined amount.

The controller 172 may activate the humidification unit 164 in response to determining the fan coil is in a heating mode. Similarly, the controller 172 may deactivate the humidification unit 164 when the fan coil 100 is not in a heating mode. An advantage of this design is that water mist is not generated unless the air flow is to be heated. Heating the air flow may reduce its relative humidity and thereby allow the air flow to better absorb the water mist. This can reduce accumulation of water (e.g., agglomerated water droplets in the water mist) inside the fan coil 100.

The humidity sensor 186 is operable to measure the humidity of the air surrounding the sensor 186. The humidity sensor 186 may be any suitable sensor for sensing humidity, such as a capacitive sensor, a resistive sensor, a gravimetric sensor, an optical sensor, etc. As shown in FIG. 2, the humidity sensor 186 can be positioned in the air flow path 136 of the fan coil 100. In the illustrated example, the humidity sensor 186 is positioned in the air flow path 136 downstream of the heat exchange unit 160. It will be appreciated that more than one humidity sensor 186 may be provided and it may be provided at various locations. For example, it may be located to sense the humidity level in a room or at any location in fan coil 100.

The humidity sensor 186 may be communicatively connected to the controller 172 (wired, wirelessly). In operation, the humidity sensor 186 can provide humidity signals to the controller 172. The humidity signals can indicate the humidity of the air in the air flow path 136 measured by the humidity sensor 186.

The controller 172 may activate or deactivate the humidification unit 164 in response to the humidity signals received from the humidity sensor 186. For example, the controller 172 may deactivate the humidification unit 164 when the humidity level in the air flow path 136 is above a predetermined humidity level. Similarly, the controller 172 may activate the humidification unit 164 when the humidity level in the air flow path 136 is below a predetermined humidity level and, optionally, the fan coil 100 is in the heating mode. An advantage of this design is the humidification unit 164 is only activated as needed, which may reduce the overall power consumption of the humidification unit 164.

The water level sensor 174 is operable to measure the amount of liquid water within the humidification unit 164. In the illustrated example, the water level sensor 174 measures the water level (i.e., the elevation of the free surface of the liquid water) of the boiler 206. The water level sensor 174 may be any suitable sensor for measuring the water level of a humidification unit 164, such as the boiler 206, such as an optical sensor, an electrical sensor, an ultrasonic sensor, a radar sensor, etc.

The water level sensor 174 may optionally determine the water level of the boiler 206 without directly sensing the water in the boiler 206. For example, as shown in FIG. 8, the water level sensor 174 may measure the water level of a tube 176 to determine the water level of the boiler 206. In the illustrated example, the tube 176 is fluidly connected to the boiler 206. The tube 176 is positioned so that the tube 176 has a water level that is substantially equal to the water level of the boiler 206. An advantage of this design is that the water level sensor 174 can be located remote from the humidification unit 164. The humidification unit 164 may at operate at high temperatures that may damage components located proximate to the humidification unit 164.

In the example shown in FIG. 8, the water level sensor 174 is an optical sensor. In the illustrated example, the optical water level sensor 174 measures the optical transmittance of the tube 176 at a particular elevation to detect the presence of water in the tube 176 at that elevation. The optical transmittance of the tube 176 at a particular elevation is relatively higher when the tube 176 contains water relative to when the tube 176 contains air at that elevation. In the illustrated example, the water level sensor 174 includes an optical transmitter and an optical receiver. The optical transmitter emits light towards the tube 176. A first portion of the light is transmitted through the tube 176 (i.e., through the water or air stored therein) and a second portion of the light is reflected back towards the optical receiver. The optical receiver measures the quantity of reflected light to determine the optical transmittance and therefore the presence of water at a particular elevation of the tube 176.

The water level sensor 174 may include any number or type of optical transmitters or receivers. In the illustrated example, the water level sensor 174 includes three pairs of infrared transmitters and receivers. Each pair of infrared transmitter and receiver is positioned to detect a particular water level of the tube 176 (and the boiler 206). For example, a first transmitter and receiver pair may be used to detect an under filled water level, a second transmitter and receiver pair may be used to detect a desired water level, and a third transmitter and receiver pair may detect an over filled water level.

The water level sensor 174 can provide water level signals to the controller 172. The water level signals may provide an indication of the water level of the boiler 206 measured by the water level sensor 174. The water level signals may trigger the controller 172 to control various aspects of the humidification unit 164.

For example, the controller 172 may deactivate the boiler 206 in response to a water level signal provided when the boiler 206 is above a predetermined water level, or when the boiler 206 is below a predetermined water level. An advantage of this design is that humidification unit 164 can deactivate the boiler 206 when there is excessive or insufficient water, to avoid damaging the humidification unit 164.

Operating the humidification unit 164 with excessive water may cause water to enter the water vapor outlet 204. Operating the humidification unit 164 with insufficient water may cause the humidification unit 164 to overheat.

Optionally, the controller 172 may regulate the water level of the boiler 206, based on a water level signal provided by the water level sensor 174. For example, the controller 172 may be operably connected to the inlet and outlet valves 196 and 198. The controller 172 may be provided with a water level signal from the water level sensor 174 when the water level in the boiler 206 is above or below a predetermined water level. In response, the controller 172 may actuate the inlet valve 196 or the outlet valve 198 to admit water to the boiler 206 or drain the boiler 206. An advantage of this design is that the humidification unit 164 can be operated to maintain a desired water level within the boiler 206, and avoid under filling or overfilling the boiler 206.

In the illustrated example, the water level sensor 174 is shown mounted on the controller 172. However, it should be appreciated that in alternate embodiments, the water level sensor 174 may located remote from the controller 172.

Flushing the Boiler

In accordance with this aspect, the water vapor (mist) producing element of a humidification unit is flushed to reduce or prevent the buildup of minerals and/or microbial growth in the water vapor (mist) producing element. The following is a general description of a method that may be implemented using a boiler of a humidification unit. The following description contains various features which may be used individually or in any combination or sub-combination. For ease of exposition, the method is described below with reference to the example boiler 206 and the example humidification unit 164 described above. However, it should be appreciated that the method may be implemented with any boiler of any humidification unit.

Figure 9:
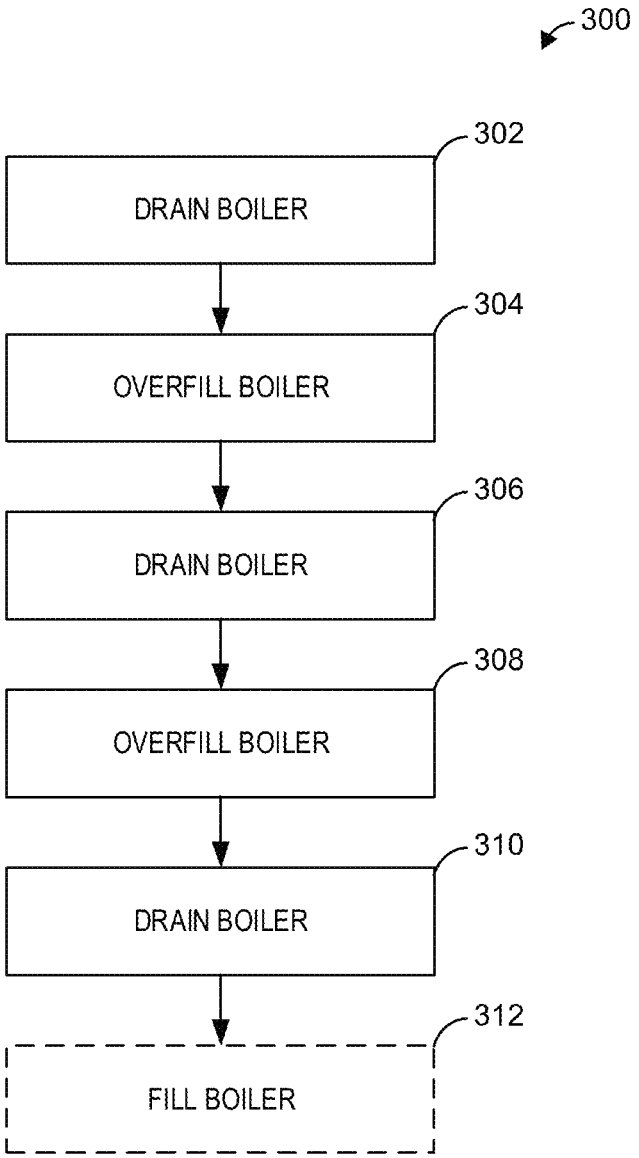
FIG. 9 is a flowchart of an example method of operating a boiler of a humidification unit, in accordance with an embodiment; and, FIG. 10 is a flowchart of another example method of operating a boiler of a humidification unit, in accordance with an embodiment.

Referring to FIG. 9, there is shown an example method 300 for operating the boiler 206 of the humidification unit 164. The method 300 may be used to flush the boiler 206 by repeatedly draining and filling the boiler 206. Microbes and/or minerals within the boiler 206 may be removed along with the water as the water is drained from the boiler 206.

An advantage of the flushing method 300 is that the accumulation of minerals within the boiler 206 may be reduced. Minerals dissolved in water may be deposited in the boiler 206 over time, as liquid water is converted into water vapor. The buildup of residual minerals within the boiler 206 may reduce the efficiency of the humidification unit 164, reducing heat transfer efficiency or increasing water boiling turbidity. In addition, the flushing method 300 may reduce microbial growth within the boiler 206. Microbes, such as bacteria or fungi, may grow within the boiler 206 when water is stored for long periods of time. The microbes may present health risks when discharged from the boiler 206.

Prior to the commencement of the flushing method 300, the boiler 206 is initially filled to a first water level. The first water level is typically the water level of the boiler 206 during normal operation. The flushing method 300 begins at 302, when the boiler 206 is drained to substantially remove water from the boiler 206. For example, the controller 172 may actuate the outlet valve 198 to discharge water from the boiler 206.

The boiler 206 may be deactivated prior to step 302. For example, the controller 172 may stop the boiling of water within the boiler 206 prior to draining the boiler 206 at 302.

At 304, the boiler 206 is subsequently filed with water to a second water level. For example, the controller 172 may actuate the inlet valve 196 to admit water into the boiler 206. The controller 172 may control the inlet valve 196 based on water level signals received from the water level sensor 174 indicating when the boiler 206 is at the second water level. The second water level is greater than the first water level (i.e., which the boiler 206 is initially filled prior to the commencement of the flushing method 300). Overfilling the boiler 206 beyond the normal water level of the boiler 206 may allow additional minerals and/or microbes to be removed when the boiler 206 is subsequently drained.

At 306, the boiler 206 is subsequently drained again to substantially remove water from the boiler 206. Similar to at 302, the controller 172 may actuate outlet valve 198 to discharge water from the boiler 206 again.

At 308, the boiler 206 is subsequently filled with water, optionally to a level above the first water level such as to the second water level. Similar to at 304, the controller 172 may actuate the inlet valve 196 to admit water into the boiler 206 based on water level signals received from the water level sensor 174. Overfilling the boiler 206 a second time may remove additional minerals and/or microbes which may not have been removed by the first overfill and drain (i.e., at 304 and 306) once the boiler 206 is subsequently drained.

At 310, the boiler 206 is subsequently drained to substantially remove water from the boiler 206 again. Similar to at 302 and 306, the controller 172 may actuate the outlet valve 198 to discharge water from the boiler 206.

Optionally, at 312, the boiler 206 is subsequently filled with water to the first water level. For example, the controller 172 may actuate the inlet valve 196 to admit water into the boiler 206 based on water level signals received from the water level sensor 174. By filling the boiler 206 back to the first water level, the boiler 206 may be ready for normal operation. For example, subsequent to step 312, the controller 172 may activate boiler 206 to boil the water in the boiler 206. In other embodiments, step 312 may be omitted. That is, the flushing method 300 may conclude at 310. For example, the boiler 206 may not be filled in anticipation that the boiler 206 will remain inactive for a relatively long period of time. Storing substantially no water in the boiler may prevent microbial growth in the boiler 206 while the boiler 206 is inactive. In such embodiment, controller 172 may first send signal to fill the boiler 206 when the fan coil is in a heating mode prior to energizing boiler 206.

In some embodiments, the flushing method 300 may be initiated in response to the detection of a trigger condition. That is, prior to draining the boiler 206 (i.e., at 302, 306, and 310) and filling the boiler 206 (i.e., at 304 and 308), a condition triggering the commencement of the flushing method 300 is detected. In other words, the boiler is only drained (i.e., at 302, 306, and 310) and filled (i.e., at 304, 308, and 312) if the trigger condition is detected. Various trigger conditions may cause the commencement of the flushing method 300.

In some embodiments, the trigger condition may be the boiler 206 being inactive for a predetermined time period. For example, the inactive predetermined time period may be between 18 and 48 hours, 18 and 36 hours, 24 hours, 48 to 96 hours, 54 to 90 hours, or 72 hours. Flushing the boiler 206 when the boiler 206 is inactive may reduce microbial growth within the idle water of the boiler 206.

In some embodiments, the trigger condition may be the boiler 206 being active for a predetermined time period. For example, the active predetermined time period may be over 15 minutes, over 30 minutes, or 60 minutes. Flushing the boiler 206 when the boiler 206 is active may reduce the buildup of minerals deposited by evaporating water.

In some embodiments, the trigger condition may be the boiler 206 containing water exceeding a predetermined salinity level. For example, the boiler 206 may include one or more sensors for measuring the salinity level of the water in communication with the controller 172. In some embodiments, the trigger condition may be the boiler 206 exceeding a predetermined water level when the humidification unit is active. The turbidity of the water within the boiler 206 during boiling may increase when the water has a high salinity level.

In some embodiments, there may be more than one trigger condition, and the flushing method 300 may be initiated in response to the trigger condition that occurs first. For example, the trigger conditions may include the boiler 206 being inactive for an inactive predetermined time period and the boiler 206 being active for an active predetermined time period. The commencement of the flushing method 300 may be triggered by whichever trigger condition occurs first.

In some embodiments, the flushing method 300 may be initiated more than once in response to the detection of more than one trigger condition. For example, the flushing method 300 may be initiated in response to the detection of a first trigger condition. Subsequent to the executing the flushing method 300, a second trigger condition may be detected, triggering a second instance of the flushing method 300. For example, the first trigger condition may be the boiler 206 being inactive for a first inactive predetermined time period and the second trigger condition may be the boiler 206 being inactive for a second inactive predetermined time period that is greater than the first inactive predetermined time period. For instance, the first inactive predetermined time period may be between 18 and 48 hours, between 18 and 36 hours, or 24 hours, and the second predetermined time period may be between 48 and 96 hours, 54 and 90 hours, or 72 hours.

Figure 10:
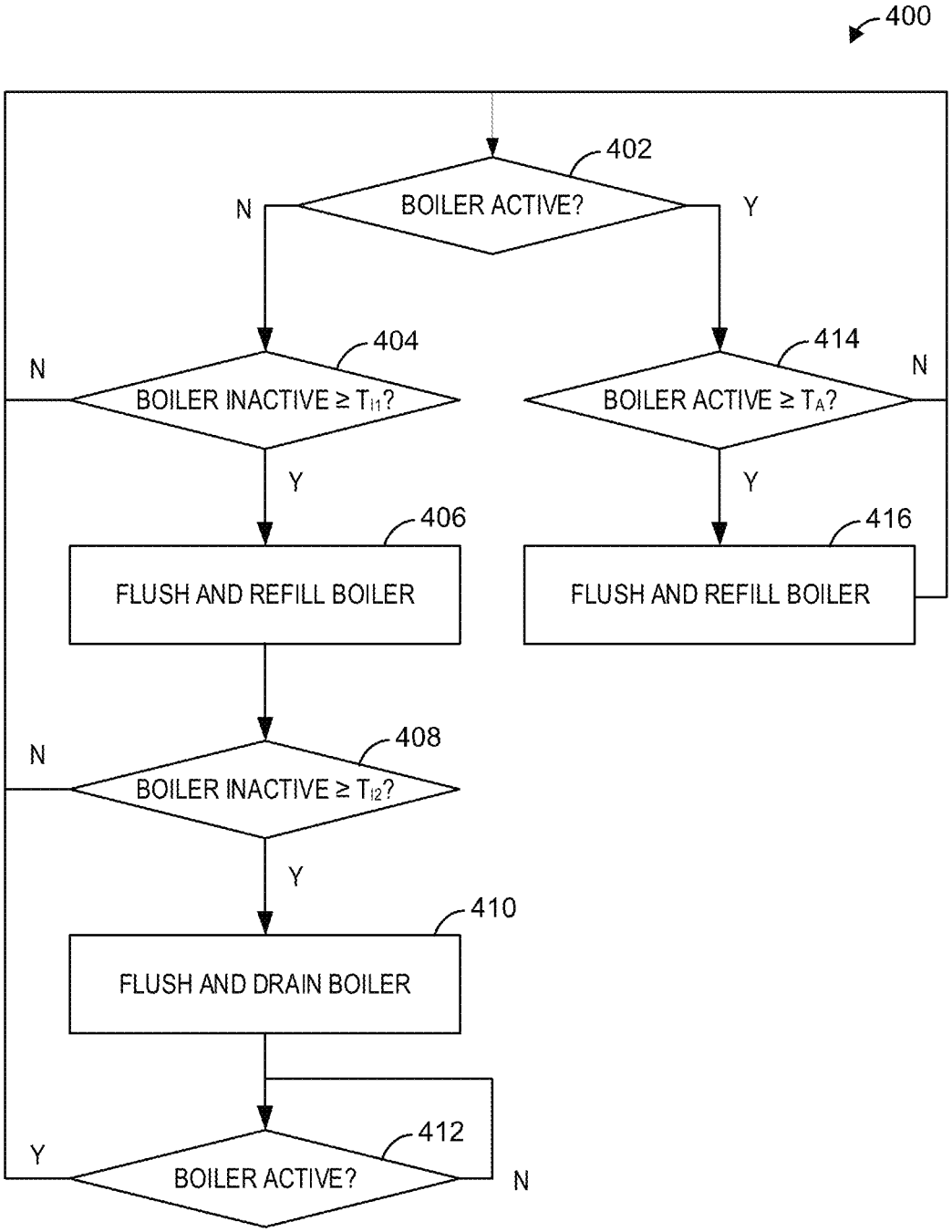

Referring now to FIG. 10, there is shown another example method 400 of operating the boiler 206 of the humidification unit 164, in accordance with an embodiment. The method 400 may be used to flush the boiler 206 in accordance with the flushing method 300 in response to various trigger conditions.

The method 400 begins at 402, where the operational state of the boiler 206 is determined. If the boiler 206 is inactive, the method 400 proceeds to 404. Alternatively, if the boiler 206 is active, the method 400 proceeds to 414.

At 404, the amount of time that the boiler 206 has been inactive is determined. If the inactivity time of the boiler is greater than or equal to a first inactive predetermined time period (i.e., $T_{I1}$), the method 400 proceeds to 406. Otherwise, the method 400 proceeds back to 402. For example, the first inactive predetermined time period may be between 18 and 48 hours, between 18 and 36 hours, or 24 hours.

At 406, the boiler 206 is flushed in accordance with the flushing method 300. The boiler 206 is filled in accordance with optional step 312 of the flushing method 300.

At 408, if the inactivity time of the boiler 206 is greater than or equal to a second inactive predetermined time period (i.e., $T_{I2}$), the method 400 proceeds to 410. Otherwise, the method proceeds back to 402. For example, the second predetermined time period may be between 48 and 96 hours, 54 and 90 hours, or 72 hours.

At 410, the boiler 206 is flushed in accordance with the flushing method 300 again. However, in contrast to step 406, the boiler 206 is not filled, by skipping step 312 of the flushing method 300. Accordingly, following the execution of step 410, the boiler 206 is substantially empty.

At 412, similar to at 402, the operational state of the boiler 206 is determined. If the boiler 206 is not active, the method 400 proceeds to back to 412. Alternatively, if the boiler 206 is active, the method proceeds back to 402.

At 414, the length of time that the boiler 206 has been active is determined. If the activity time of the boiler is greater an active predetermined time period (i.e., TA), the method 400 proceeds to 416. Otherwise, the method proceeds back to 402. For example, the active predetermined time period may be over 15 minutes, over 30 minutes, or 60 minutes.

At 416, similar to at 406, the boiler 206 is flushed in accordance with the flushing method 300. The boiler is refilled in accordance with optional step 312. The method then proceeds back to 402.

It will be appreciated that different flushing patterns may be used based upon different triggering signals. Therefore, if the triggering event is the first inactive predetermined time period, only a single flushing operation 304 may be conducted. However, after a longer inactive predetermined time period, two flushing operations (operations 304 and 308) may be conducted.

Similarly, after a first shorter total period of operation (e.g., 15-30 minutes) only a single flushing operation 304 may be conducted. However, after a longer total period of operation (e.g., over 45 minutes, over 60 minutes, etc.), two flushing operations (operations 304 and 308) may be conducted While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A method for operating a boiler of a humidification unit, the boiler initially filled to a first water level, the method comprising:

a) interrupting a normal operation of the humidification unit; and b) conducting, during the interruption, a flush cycle including:

i) draining the boiler to substantially remove water from the boiler;

ii) subsequently filling the boiler with water to a second water level, the second water level being greater than the first water level;

iv) subsequently draining the boiler to substantially remove water from the boiler.

2. The method of claim 1, further comprising, prior to interrupting the normal operation, detecting a trigger condition, wherein the flush cycle is conducted if the trigger condition is detected.

3. The method of claim 2, wherein detecting the trigger condition comprises determining that the boiler has been inactive for a first inactive predetermined time period.

4. The method of claim 3, wherein the first inactive predetermined time period is between 18 and 48 hours.

5. The method of claim 3, wherein the first inactive predetermined time is between 18 and 36 hours.

6. The method of claim 2, wherein detecting the trigger condition comprises determining that the boiler has been active for a first active predetermined time period.

7. The method of claim 6, wherein the first active predetermined time period is over 15 minutes.

8. The method of claim 6, wherein the first active predetermined time period is over 30 minutes.

9. The method of claim 2, wherein detecting the trigger condition comprises determining that the boiler has been inactive for a first inactive predetermined time period or the boiler has been active for a first active predetermined time period, whichever occurs first.

10. The method of claim 3, further comprising:

a) subsequent to conducting the flush cycle, filling the boiler with water to the first water level, and subsequently resuming the normal operation of the humidification unit;

b) subsequent to the resumption of the normal operation of the humidification unit, determining that the boiler has been inactive for a second inactive predetermined time period, wherein the second inactive predetermined time period is greater than the first inactive predetermined time period; and, c) in response to determining that the boiler has been inactive for the second inactive predetermined time period, conducting a flush and drain cycle including:

i) draining the boiler to substantially remove water from the boiler;

ii) subsequently filling the boiler with water to the second water level;

iii) subsequently draining the boiler to substantially remove water from the boiler;

iv) subsequently filling the boiler with water to the second water level; and, v) subsequently draining the boiler to substantially remove water from the boiler.

11. The method of claim 10, wherein the first inactive predetermined time period is between 18 and 48 hours and the second inactive predetermined time period is between 48 and 96 hours.

12. The method of claim 2, wherein detecting the trigger condition comprises determining that the boiler exceeds a predetermined water level when the boiler is active.

13. The method of claim 2, wherein detecting the trigger condition comprises determining that the boiler contains water exceeding a predetermined salinity level.

14. The method of claim 1, further comprising, subsequent to conducting the flush cycle, filling the boiler with water to the first water level, and subsequently resuming the normal operation of the humidification unit.

15. The method of claim 14, wherein the normal operation of the humidification unit includes activating the boiler to boil water, and interrupting the normal operation includes deactivating the boiler.

16. The method of claim 15, further comprising:

a) subsequent to determining that the boiler has been inactive for a first inactive predetermined time period, determining that the boiler has been inactive for a second inactive predetermined time period, wherein the second inactive predetermined time period is greater than the first inactive predetermined time period; and, b) in response to determining that the boiler has been inactive for the second inactive predetermined time period, conducting a flush and drain cycle including:

i) draining the boiler to substantially remove water from the boiler;

ii) subsequently filling the boiler with water to the second water level;

iii) subsequently draining the boiler to substantially remove water from the boiler;

iv) subsequently filling the boiler with water to the second water level; and, v) subsequently draining the boiler to substantially remove water from the boiler.

17. A method for performing a flush cycle of a boiler of a humidification unit, the boiler initially filled to a first water level, the method comprising:

a) draining the boiler to substantially remove water from the boiler;

b) subsequently filling the boiler with water to a second water level, the second water level being different from the first water level;

c) subsequently draining the boiler to substantially remove water from the boiler;

d) subsequently filling the boiler with water to the second water level; and e) subsequently draining the boiler to substantially remove water from the boiler.

18. A method for operating a boiler of a humidification unit, the boiler initially filled to a first water level, the method comprising:

a) determining that an inactivity time of the boiler is greater than or equal to a predetermined inactivity time period;

b) conducting, in response to the determination of step a), a flush and drain cycle such that the boiler is substantially empty in anticipation that the boiler will remain inactive for a relatively long period of time, the flush and drain cycle including:

i) draining the boiler to substantially remove water from the boiler;

ii) subsequently filling the boiler with water to a second water level;

iii) subsequently draining the boiler to substantially remove water from the boiler;

iv) subsequently filling the boiler with water to the second water level; and v) subsequently draining the boiler to substantially remove water from the boiler and leave the boiler in a substantially empty state; and c) storing the boiler in the substantially empty state.

19. The method of claim 18, further comprising at step d), subsequent to step c), monitoring the boiler and leaving the boiler in the substantially empty state while the boiler remains inactive.

20. The method of claim 19, wherein step d) includes filling the boiler to the first water level when a fan coil is in a heating mode prior to energizing the boiler.

* * * * *